United States Patent [19]

Sieck

[11] Patent Number: 4,779,420

[45] Date of Patent: Oct. 25, 1988

[54] THERMAL EXCHANGER ENGINE

[76] Inventor: Charles A. Sieck, 51 South Ter., Wormleysburg, Pa. 17043

[21] Appl. No.: 100,476

[22] Filed: Sep. 24, 1987

[51] Int. Cl.[4] ..... F02G 1/04

[52] U.S. Cl. ..... 60/517; 60/682; 60/526; 60/508; 60/512

[58] Field of Search ..... 60/508–515, 60/516, 517, 650, 682

[56] References Cited

U.S. PATENT DOCUMENTS 4,488,402 12/1984 Sieck ..... 60/526 X

*Primary Examiner*—Allen M. Ostrager

*Attorney, Agent, or Firm*—Nies, Webner, Kurz & Bergert

[57] ABSTRACT

An internal thermal exchanger engine which, in one embodiment, includes a cylinder having side walls and an enclosed lower end, with a piston mounted for reciprocal movement within the cylinder, and with a heat exchanger reciprocally mounted within the cylinder between the piston and the lower end of the cylinder. A gas phase fluid is enclosed between the piston and the lower end of the cylinder. The heat exchanger, which has perforated end portions, contains a foraminous heat conductive material distributed throughout the entire volume of the heat exchanger, thus allowing the gas phase fluid to pass freely through the heat exchanger as the heat exchanger moves between the piston and the lower end of the cylinder. A solenoid mounted on the piston operates an exchanger rod secured to the heat exchanger so as to cause the heat exchanger to move reciprocally within the cylinder. A combustion chamber is provided at the lower end of the cylinder to provide a source of heat.

7 Claims, 2 Drawing Sheets

FIG. 1 PRIOR ART
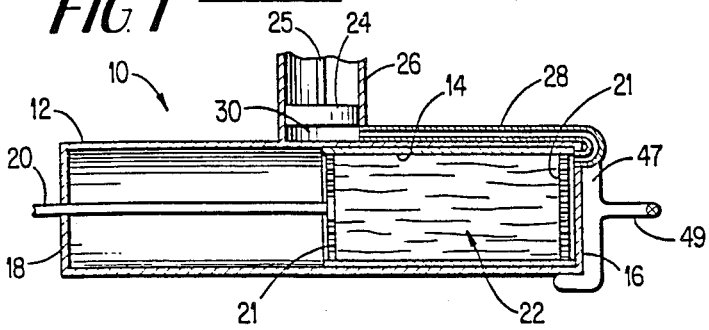
FIG. 2 PRIOR ART
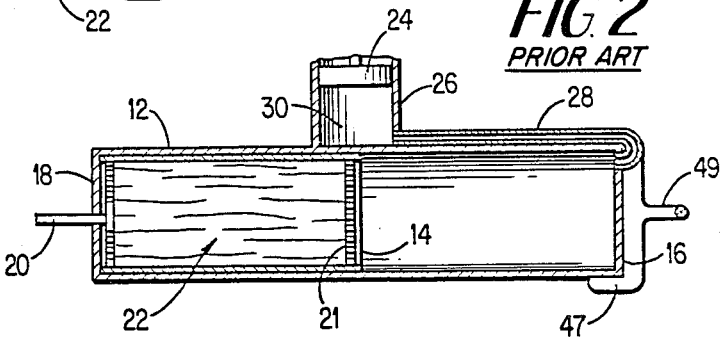
FIG. 3 PRIOR ART
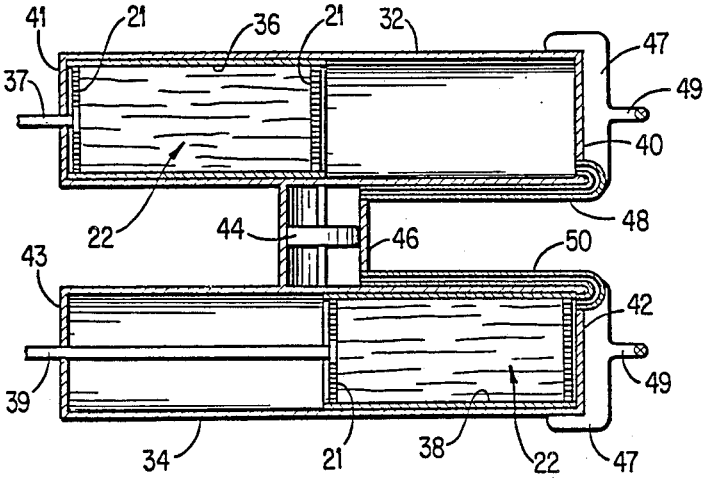
FIG. 5 PRIOR ART
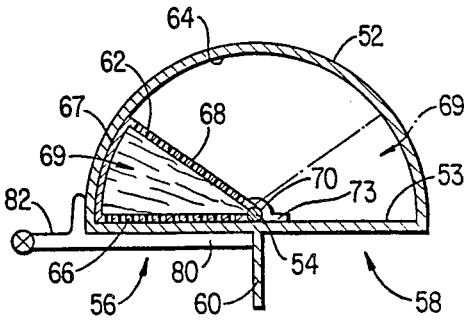
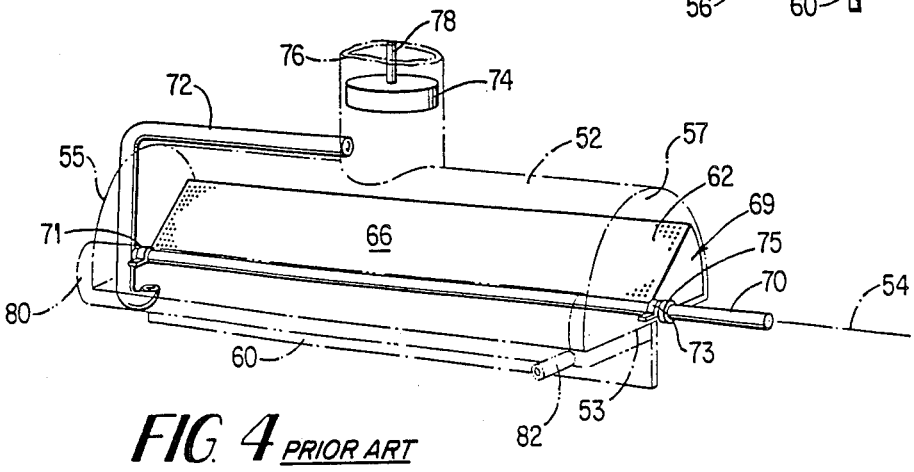
FIG. 4 PRIOR ART

THERMAL EXCHANGER ENGINE

BACKGROUND AND SUMMARY OF THE INVENTION

The present invention relates to a heat engine construction. More particularly, the present invention relates to an engine construction including a heat exchanger which is movable between two extreme positions within an enclosed space, and which produces a variation in pressure which may be transmitted to a working piston. The present invention is an improvement of the thermal exchanger engine as described in U.S. Pat. No. 4,488,402.

Various types of engines are known which are employed to operate as heat engines, with such engines being described, for example, in U.S. Pat. Nos. 3,956,894 to Tibbs; 3,878,680 to Dauvergne; 4,077,221 to Maeda; and 4,270,351 to Kuhns.

By the present invention, there is provided an internal thermal exchanger engine which, in one embodiment, includes an enclosed shell or chamber having hot and cold end portions and having contained therein a heat exchanger which occupies approximately one-half the total volume of the chamber, the heat exchanger being open ended and containing heat conductive materials such as fine copper wire strands which function in heat exchange relationship with a gas contained in the chamber. In an alternative embodiment of the invention, the enclosed chamber is in the form of a semi-cylinder, with the heat exchanger of a wedge-shape construction and being freely rotatable between a hot side of the semi-cylinder and a cold side across the arc of the semi-cylinder.

In a further embodiment, the invention includes an internal heat exchanger capable of movement back and forth within a cylinder containing a separate piston.

In the present heat engine, the pressure differential is achieved in a most efficient way due to the action of the internal heat exchanger which removes energy from the gas as the exchanger moves from cold to hot end locations, storing such energy within the system in the exchanger material, creating low pressure in the chamber and then releasing energy to the gas to create high pressure in the chamber as the exchanger moves from the hot to the cold end locations within the chamber.

It is an object of the present invention to provide a thermal engine which is capable of highly efficient operation.

It is a further object of the invention to utilize to the fullest extent the energy supplied during the operation of a heat engine.

It is another object of the invention to provide a thermal engine which operates within an enclosed space to produce a pressure differential which may be transmitted to a location outside the enclosed space.

It is another object of the invention to re-cycle heat energy within the heat engine system by the use of an internal heat exchanger.

It is another object of the invention to provide a system which removes energy from a gas contained within an enclosed chamber and which transfers this energy to a working piston.

BRIEF DESCRIPTION OF THE DRAWINGS

The objects and advantages of the thermal exchanger engine of the present invention will be more clearly understood from the following description of the preferred embodiments, taken in conjunction with the accompanying drawings wherein:

FIG. 1 is a diagrammatic representation of a single cylinder embodiment of the engine of the prior art;

FIG. 2 is a diagrammatic representation of the engine of FIG. 1, with the heat exchanger shown at the opposite end location;

FIG. 3 is a diagrammatic representation of a double cylinder embodiment of the engine of the prior art;

FIG. 4 is a diagrammatic perspective view of a semi-cylinder embodiment of the engine of the prior art;

FIG. 5 is a diagrammatic representation of an end view of the engine of FIG. 4, with the heat exchanger shown as rotated to the opposite extreme position from that of FIG. 4;

DESCRIPTION OF THE PREFERRED EMBODIMENTS

Figure 6:
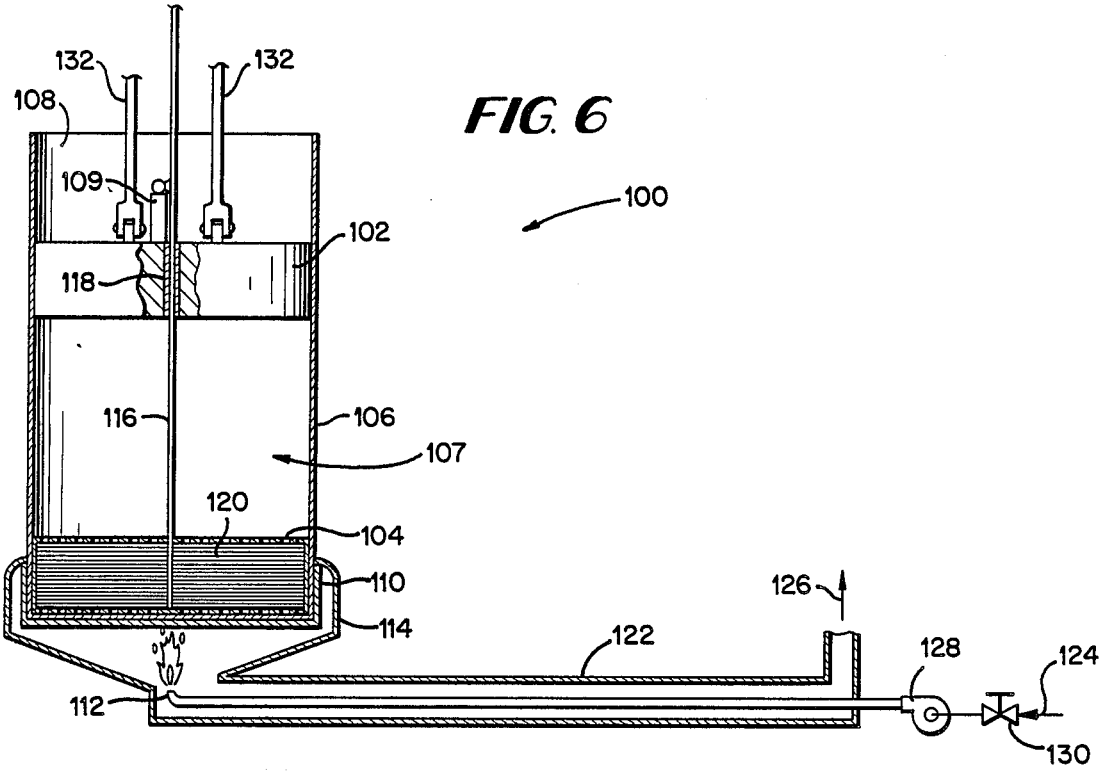
FIG. 6 is a diagrammatic representation of an embodiment of the engine of the present invention.

In the embodiment of the prior art as shown in FIGS. 1 and 2, there is provided a thermal engine 10, including enclosed cylindrical chamber 12 and cylindrical heat exchanger 14 contained internally within the chamber 12. The chamber 12 is constructed of a heat conductive material, preferably a non-ferrous metal, being closed at the ends 16, 18 and containing gas either at atmospheric pressure or pressurized. One end 16 of the chamber 12 is maintained at a high temperature such as about 1100° F. on the external portion thereof by means of a heat source 47 while the other end 18 of the chamber 12 is at ambient temperature, for example, about 70° F., on the external portion.

The heat exchanger unit 14 is also of cylindrical shape, fitting inside the chamber 12 with a close tolerance so that the outer walls of the exchanger 14 slide freely within the interior walls of the chamber 12. The heat exchanger 14 is open-ended and, in one embodiment, is of a length equal to approximately one-half the length of the chamber 12. The heat exchanger 14 is thus free to move from one end 16 to the other 18 of chamber 12.

The exchanger 14 is constructed of a heat conductive material and is filled with a material 22 which functions in heat exchange relationship with the gas contained in the chamber 12. The material 22 should be of a foraminous nature, i.e., having small openings therein to allow the gas within the system to pass through the exchanger 14. In a specific embodiment, the material 22 employed was copper wire screening, of a size of approximately 1/32 inch in diameter. In general, the diameter of the wire or other such material would depend on the size of the chamber and the desired speed of oscillation of the heat exchanger. Such screening may be employed in horizontal strips or vertical layers which effectively fill the volume of the heat exchanger 14 while allowing gas to pass freely through the exchanger 14 as the exchanger 14 moves from one end of the chamber 12 to the other.

A working piston 24 operating within a cylinder 26 is located adjacent the chamber 12, with the cylinder 26 being in fluid communication with the hot end 16 of the chamber 12 through a conduit 28 leading from the hot end 16 of the chamber 12 to the enclosed chamber 30 of cylinder 26.

Movement of the heat exchanger 14 within the chamber 12 may be controlled by mechanical means such as a shaft 20 which extends through the wall at one end 18 of the chamber 12, being in sliding, fluid tight engagement therewith. At each end of the exchanger 14 there is located a perforated disk 21. These disks 21 hold the heat exchanger material 22 in place and are secured to the inner wall of the exchanger shell. The disks 21 allow free passage of gas through the exchanger 14. The shaft 20 is attached to the disk 21 at the cold end of the chamber 12.

The shaft 20 is connected at a point exterior to the chamber 12 to a working member (not shown) which provides for reciprocation of the shaft 20, thus providing for controlled movement of the heat exchanger 14 between the ends 16, 18 of the chamber 12. Alternatively, the heat exchanger 14 may be controlled in such movement by means such as electromagnetic forces outside the chamber 12 which act upon the exchanger 14. Such electromagnetic means could, for example, be in the form of a coil of wire surrounding a portion of the cold end of the cylinder 12, through which is passed an alternating current which acts upon a permanently magnetized exchanger shell, thus causing the exchanger 14 to move from end to end within the cylinder 12. Operation of the heat exchanger 14 is supplemented as necessary by additional heat energy input at the hot end 16 of the chamber 12, with such additional heat energy replacing energy which is removed from the system as work output.

Vaporizing liquid such as water may be added inside the chamber 12 to increase the pressure fluctuation. Such liquid will vaporize when exposed at the hot end 16 and will condense as it is forced into the exchanger 14, when the exchanger 14 moves from the cold end 18 to the hot end 16 of the chamber 12. When the exchanger 14 moves from the hot end 16 to the cold end 18, the droplets of liquid will be forced to the hot end 16 where such droplets will again vaporize.

While the chamber 12 is preferably constructed of a nonferrous metal, the mid-section of the chamber 12, approximately one-half the total length thereof, may be alternatively constructed of an insulating material, in order to reduce the heat transferred through the walls of the chamber 12.

As the heat exchanger 14 is moved from one end of the chamber 12 to the other, there is produced an increase and a decrease in pressure within the chamber 12. The pressure differential is achieved in a most efficient way due to the action of the internal heat exchanger 14 as it removes energy from the gas within the chamber 12, as exchanger 14 moves from cold end 18 to the hot end 16 position, storing it within the system in the exchanger material 22, creating low pressure in the chamber 12 and then releasing energy to the gas to create high pressure within the chamber 12 as the exchanger 14 moves from the hot end 16 to the cold end 18. Such pressure fluctuations are transmitted to the working piston 24 which, in turn, transmits the output to an operative member (not shown) through piston rod 25.

The gas employed within chamber 12 will preferably have properties including high thermal conductivity, a high coefficient of thermal expansion, low specific heat and low corrosive tendencies. Examples of suitable gases include air, helium, nitrogen and argon. As an example of the gas pressure employed in chamber 12, in one embodiment, the pressure of the gas varies from about 8 psia when the main portion of the gas is at the cold end 18 with the exchanger 14 at the hot end 16, as shown in FIG. 1, and with the operating piston 24 at the top of chamber 30, to about 40 psia when the main portion of the gas is at the hot end 16, with exchanger 14 at the cold end 18 as shown in FIG. 2, and operating piston 24 is at the bottom of chamber 30.

As the thermal engine 10 is operated, in one embodiment, the temperature of the gas will be approximately 200° F. as the gas enters the area of the cold end 18 after passing through the exchanger 14. The surrounding shell of the cold end 18 decreases the temperature of the gas to approximately 100° F. As the gas enters the area of the hot end 16 after passing through the exchanger 14, the temperature of the gas is approximately 600° F. The surrounding shell of the hot end 16 increases the temperature of the gas to approximately 900° F. The external temperatures at the cold 18 and hot 16 ends are approximately 70° F. and 1100° F., respectively in this embodiment.

A suitable heat source is employed at the hot end 16 of the chamber 12 to increase the temperature of the gas from 600° F. to 900° F., prior to expansion of the gas into the operating piston chamber 30. The heat source may be supplied, for example, by the use of jacket 47 of the heat conductive material secured around the circumference of the hot end 16, and with a suitable heated liquid or gas being admitted to the interior of the jacket 47 through the valved conduit 49.

In the prior art embodiment as shown in FIG. 3, two cylindrical chambers 32, 34 are employed, with each chamber 32, 34 containing a respective cylindrical heat exchanger 36, 38. The chambers 32, 34 have respective hot 40, 42 and cold 41, 43 ends. The hot ends 40, 42 of the respective chambers 32, 34 are in fluid communication with a common piston 44 and cylinder 46 arrangement through respective conduits 48, 50 which communicate with opposite ends of the cylinder 46. The controlled movement of heat exchangers 36, 38 by respective connecting shafts 37, 39 or other suitable means allows the pressure with cylinder 46 to be varied so as to operate piston 44 within cylinder 46 in the desired manner. Piston 44 transmits the output to an operative member (not shown) connected to piston 44 for relative movement therewith.

In the prior art embodiment as shown in FIGS. 4 and 5, the enclosed chamber 52 for the heat engine is in the form of a semi-cylinder, including semi-cylindrical wall 64 joined to planar base 53, and with vertical end walls 55, 57 which close off the chamber 52 at each end. The planar base 53 is constructed of a highly heat conductive material and is equally divided along the longitudinal center line 54 into hot 56 and ambient 58 temperature sides. A vertical insulating wall 60 is attached to base 53 along the longitudinal centerline 54 thereof and extends generally perpendicularly to the base 53 to separate the hot 56 and cold 58 areas below the chamber 52. Wall 60 should extend a sufficient distance below base 53 to prevent any substantial transfer of heat from the hot end 56 to the cold end 58 of the chamber 52 on the exterior thereof.

Located within the chamber 52 and extending the length thereof is a heat exchanger unit 62 of wedge-shaped cross section, with perforated side walls 66, 68 which define the wedge shape being attached along their line of intersection to a rod member 70 which lies along the longitudinal center line 54 of the base 53. Rod member 70 is rotatably mounted to the base 53 by suitable securing means 71, 73 located at each end of the base 53. Heat exchanger unit 62 thus extends from the center line 54 of the base 53 to the semi-cylindrical wall 64 of the chamber 52, with the exchanger 62 having an end wall 67 attached to the outer ends of walls 66, 68. End wall 67 is contiguous to but spaced sufficiently from wall 64 of chamber 52 to allow the heat exchanger 62 to move freely within the chamber 52 as the exchanger 62 is rotated. The rod member 70 extends exteriorly of one end wall 57 of the chamber 52 through a packing sleeve 75 and is connected to a suitable power source (not shown) for controlling the rotation of rod 70 and the attached heat exchanger 62.

The heat exchanger 62 may occupy a space such as, for example, approximately 25% of the volume within the chamber 52 and the perforated side walls 66, 68 allow the free flow of gas through the exchanger 62. The exchanger 62 is loosely filled with a suitable foraminous material 69 such as fine copper wire strands similar to that previously described.

Rotation of the rod member 70 through an angle of approximately 140° causes the heat exchanger 62 to move from one side of the chamber 52 to the other, as shown in dashed lines in FIG. 5, forcing gas through the exchanger 62 as it moves. As the heat exchanger 62 is rotated from the hot side 56 to the ambient or cold side 58 of the chamber 52, for example, with the gas traveling freely through the exchanger 62, the high temperature of the exchanger material 69 heats the gas, increasing the temperature and the pressure of the confined gas. Rotation of the heat exchanger 62 from the cold side 58 to the hot side 56, on the other hand, removes heat energy from the gas to the exchanger material 69, resulting in a decrease in temperature and pressure of the confined gas. This pressure variation is relayed by a suitable conduit 72 from the hot end 56 to a working piston 74 and cylinder 76 unit. The output of piston 74 is transmitted to an operative member (not shown) through piston rod 78.

The temperatures and pressures employed in the embodiments of FIGS. 1, 2 and 3 may also be employed in the embodiments of FIGS. 4 and 5. The heat source for the hot side 56 of the chamber 52 may, for example, be supplied by the use of a jacket 80 of a heat conductive material secured around the exterior of the hot side 56, and with a suitable heated liquid or gas being admitted to the interior of jacket 80 through valved conduit 82.

In the embodiment of the engine 100 of the present invention as shown in FIGS. 6 through 11, there is provided a piston 102 which is constructed of high conductivity metal to lower the temperature above an internal heat exchanger 104. The walls 106 of cylinder 108 within which piston 102 moves are composed of low conductivity material to minimize transfer of heat between the cylinder walls 106 and the gas 107 confined in the cylinder 108. A lower cap 110 on the lower end of cylinder 108 is composed of high conductivity metal to promote rapid heat transfer from a burner 112 in combustion chamber 114 to the heat exchanger 104.

An exchanger rod 116 passes in sliding, fluid tight engagement through a sleeve 118 in the piston 102 and is secured to the internal heat exchanger 104. The internal heat exchanger 104 contains layered screens 120 of a high conductivity, high specific heat material such as copper. A temperature gradient such as about 15° F., for example, exists between the various adjacent screen layers during operation. The upper and lower walls of the heat exchanger 104 are perforated to allow free passage of gases during operation.

The combustion chamber 114 contains a burner 112 and is provided with insulated walls which surround the base of the cylinder 108. An external heat exchanger 122 preheats the supply air 124 to the burner 112 with heat obtained from the exhaust gas 126. A blower 128 regulates airflow to the burner 112 in conjunction with a fuel supply valve 130 to maintain a proper air to fuel ratio.

Figure 7:
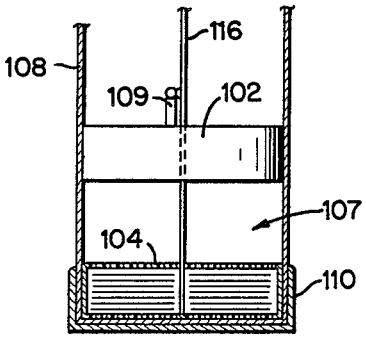
FIGS. 7 through 11 are diagrammatic representations of the engine of FIG. 6 in various positions during its cycle of operation.
Figure 8:
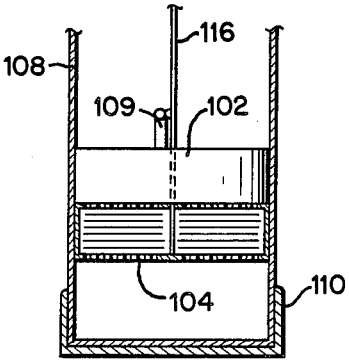
Figure 9:
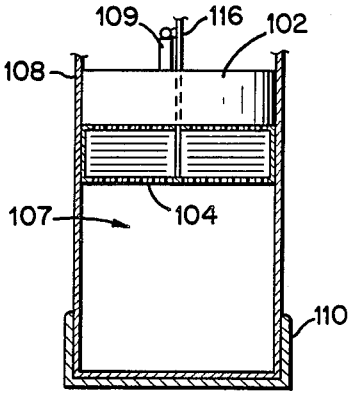
Figure 10:
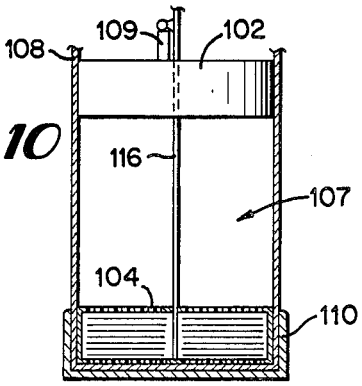
Figure 11:
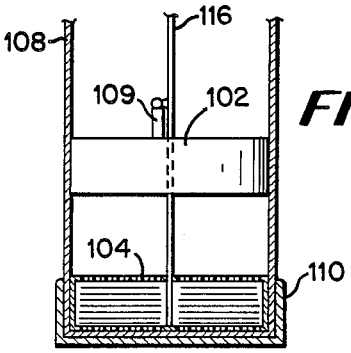

In the operation of the thermal exchanger engine 100 of this embodiment, heat applied at the base of the cylinder 108 is transferred to the internal heat exchanger 104 which is positioned at an initial lowermost position as shown in FIG. 7, increasing the temperature of the confined gas 107 in the cylinder 108. A solenoid 109 mounted on the piston 102 is operated to lift the exchanger rod 116 out of the gas area, thus lifting the heat exchanger 104 to piston 102 level, as shown in FIG. 8. The gas 107 has now moved through the exchanger 104, transferring heat from the exchanger 104 to the gas 107. The increased pressure then raises the piston 102 and exchanger 104, as shown in FIG. 9. The solenoid 109 is then operated to release the exchanger rod 116. The exchanger 104 drops, as shown in FIG. 10, removing heat from the gas into the exchanger 104. The pressure then drops and the piston 102 is drawn downward, as shown in FIG. 11, thus completing the cycle. As the piston 102 moves up and down, it transmits motion to drive a working member through means such as rod members 132.

As an example of the temperatures and pressures obtained during the various steps of this process, the following table is provided:

TABLE I

| | Gas Pressure, psia | Gas Temp., °F. | Top Screen °F. | Bottom Screen °F. |
|---|---|---|---|---|
| FIG. 7 | 15 | 200 | 300 | 1,300 |
| FIG. 8 | 35 | 1,100 | 200 | 1,100 |
| FIG. 9 | 15 | 900 | 100 | 900 |
| FIG. 10 | 7 | 150 | 200 | 1,000 |
| FIG. 11 | 15 | 200 | 300 | 1,200 |

The invention may be embodied in other specific forms without departing from the spirit or essential characteristics thereof. The present embodiments are thereof to be considered in all respects as illustrative and not restrictive, the scope of the invention being indicated by the appended claims rather then by the foregoing description and all changes which come within the meaning and range of equivalency of the claims are therefore intended to be embraced therein.

What is claimed and desired to be secured by Letters Patent is:

1. A thermal exchanger engine comprising:

a cylinder having side walls and an enclosed lower end, said side walls being formed of low conductivity material;

a piston mounted for reciprocal movement within said cylinder and enclosing a gas phase fluid between said piston and the lower end of said cylinder, said piston being composed of high conductivity metal and having a vertical bore through the central portion thereof;

a heat exchanger located within said cylinder between said piston and the lower end of said cylinder, said heat exchanger being of a size and shape so as to fit inside the cylinder with a close tolerance so that the outer walls of the exchanger are freely slidable in a vertical direction within the interior side walls of said cylinder, said heat exchanger containing a foraminous heat conductive material distributed throughout the entire volume of said heat exchanger, said heat exchanger having perforated end portions which allow said gas phase fluid to pass freely through said heat exchanger as said heat exchanger moves between the piston and the lower end of said cylinder;

an exchanger rod secured to said heat exchanger and being sliding, fluid tight engagement with the bore in said piston;

means for operating said exchanger rod to move said heat exchanger reciprocally within said cylinder; and means for heating said lower end of the cylinder.

2. The engine of claim 1 wherein a cap of highly conductive material is provided on the lower end of the cylinder to promote rapid heat transfer from said heating means to said heat exchanger.

3. The engine of claim 1 wherein said foraminous material contained in said heat exchanger is in the form of layered screens of a high conductivity, high specific heat material.

4. The engine of claim 1 wherein said heating means includes a combustion chamber containing a burner, said combustion chamber being of a shape which surrounds the lower end of said cylinder, including a portion of the side walls thereof.

5. The engine of claim 4 wherein said combustion chamber is in fluid communication with an external heat exchanger which preheats the supply air to the burner with heat obtained from the exhaust gas passing from said combustion chamber.

6. The engine of claim 5 further including blower means for regulating airflow to said burner.

7. The engine of claim 6 further including fuel supply valve means for maintaining a proper air to fuel ratio to said burner.

* * * * *